United States Patent [19]

Sawyer et al.

[11] Patent Number: 4,952,306

[45] Date of Patent: Aug. 28, 1990

[54] SLURRY HYDROPROCESSING PROCESS

[75] Inventors: Willard H. Sawyer, Dallas, Tex.; Roby Bearden, Jr., Baton Rouge, La.; Russell R. Chianelli, Somerville, N.J.; William E. Winter, Jr., Baton Rouge, La.

[73] Assignee: Exxon Research and Engineering Company, Florham Park, N.J.

[21] Appl. No.: 411,149

[22] Filed: Sep. 22, 1989

[51] Int. Cl.[5] ..... C10G 45/46; C10G 45/04

[52] U.S. Cl. ..... 208/216 R; 208/210; 208/254 H; 208/143; 208/176; 502/53

[58] Field of Search ..... 208/143, 254 H, 210, 208/216 R; 502/53

[56] References Cited

U.S. PATENT DOCUMENTS

| | | | |
|---|---|---|---|
| 2,700,015 | 1/1955 | Joyce, Jr. | 208/150 |
| 2,912,375 | 11/1959 | MacLaren | 208/149 |
| 3,254,021 | 5/1966 | Mason et al. | 502/53 |
| 3,297,563 | 1/1967 | Doumani | 208/110 |
| 3,531,398 | 9/1970 | Adams et al. | 208/216 R |
| 3,702,291 | 11/1972 | Jacquin et al. | 208/143 |
| 3,745,112 | 7/1973 | Rausch | 208/139 |
| 3,770,617 | 11/1973 | Riley et al. | 208/216 R |
| 3,841,996 | 10/1974 | Jacobsen | 208/157 |
| 3,981,796 | 9/1976 | Hilfman | 208/254 H |
| 4,108,761 | 8/1978 | Sze et al. | 208/254 H |
| 4,200,521 | 4/1980 | Stein et al. | 208/254 H |
| 4,431,526 | 2/1984 | Simpson et al. | 208/254 H |
| 4,557,821 | 12/1985 | Lopez et al. | 208/216 R |
| 4,610,779 | 9/1986 | Markley et al. | 502/53 |
| 4,619,759 | 10/1986 | Myers et al. | 208/254 H |
| 4,786,402 | 11/1988 | Anstock et al. | 208/143 |
| 4,849,093 | 7/1989 | Vauk et al. | 208/143 |

*Primary Examiner*—Helane E. Myers

*Attorney, Agent, or Firm*—Chris P. Konkol

[57] ABSTRACT

A novel slurry hydrotreating process is described which employs a hydrotreating catalyst of small particle size having a quantity of catalyst sites in excess of those required for reaction and/or adsorption of nitrogen compounds in the petroleum or synfuel feed being treated. The excess catalyst sites can therefore in effect be contacted with a low nitrogen or essentially zero nitrogen feed, allowing rapid hydrogenation of aromatics at low temperatures where equilibrium is favored. In a further aspect of the invention, the catalyst which contains adsorbed nitrogen is activated by high temperature denitrogenation.

16 Claims, 3 Drawing Sheets

SLURRY HYDROPROCESSING PROCESS

BACKGROUND OF THE INVENTION

This invention relates to the use of certain small particle catalysts in a slurry hydrotreating process for the removal of sulfur and nitrogen compounds and the hydrogenation of aromatic molecules present in light fossil fuels such as petroleum mid-distillates.

A well known application for a hydrotreating process in a refinery is the treatment of the light catalytic cracker cycle oil (LCCO) product from a catalytic cracker. The term LCCO may refer to furnace oil, diesel oil, or mixtures thereof, as distinguished from the other main product streams of the catalytic cracker, typically the gasoline and gas product stream and the heavy fuel oils product stream.

The LCCO product is relatively high in aromatic content and increasingly so as a result of the catalytic cracker being operated at a higher temperature in order to produce more gasoline. In other words, a higher gasoline conversion in the catalytic cracker is being obtained at the expense of a more aromatic LCCO product than in the past. However, the LCCO product is generally of less demand and consequently of less value than the gasoline product, and the problem of disposing of the LCCO product has arisen. One option is to hydrogenate the aromatics in the LCCO product and sell it as heating oil. However, this option may not be viable when the market for heating oil is insufficient. A second option is to make the LCCO product suitable for diesel oil stock. However, there already exists a stringent sulfur limit for diesel fuel and there is likely to be a stringent aromatics limit because of the effect of aromatics on soot formation. A third option for the LCCO product is to recycle it back to the catalytic cracker for further conversion, but since coke making is to be avoided, it is necessary to hydrogenate the LCCO before recycling.

The petroleum industry therefore hydrotreats LCCO's such as furnace oil or diesel oil, whether to upgrade the same for a final product or to upgrade them for recycle to the catalytic cracker.

Hydrotreating is a process wherein the quality of a petroleum feedstock is improved by treating the same with hydrogen in the presence of a hydrotreating catalyst. Various types of reactions may occur during hydrotreating. In one type of reaction, the mercaptans, disulfides, thiophenes, benzothiophenes and dibenzothiophenes are desulfurized. The thiophenes, mercaptans and disulfides are representative of a high percentage of the total sulfur in lighter naphthas. Benzothiophenes and dibenzothiophenes appear as the predominant sulfur forms in heavier feeds such as LCCO and VGO. Hydrotreating also removes nitrogen from various nitrogen compounds such as carbazoles, pyridines, and acridines. Hydrotreating can also hydrogenate aromatic compounds, existing as condensed aromatic ring structures with 1 to 3 or more aromatic rings such as benzene, alkyl substituted benzene, naphthalene, and phenanthrene.

The most common hydrotreating process utilizes a fixed bed hydrotreater. A fixed bed system, however, has several disadvantages or inherent limitations. At relatively low temperatures and employing a conventional catalyst, a fixed bed system is characterized by relatively low reaction rates for the hydrogenation of multi-ring aromatics and the removal of nitrogen in the material being treated. On the other hand, at relatively higher temperatures, a fixed bed system suffers from equilibrium limits with respect to the degree of aromatics hydrogenation.

Another limitation of a fixed bed system is the difficulty in controlling the temperature profile in the catalyst bed. As a result, exothermic reactions may lead to undesirably higher temperatures in downstream beds and consequently an unfavorable equilibrium. Still a further limitation of a fixed bed system is that a high pressure drop may be encountered, when employing small particle catalysts to reduce diffusion limits. Finally, a fixed bed system suffers from catalyst deactivation, which requires period shutdown of the reactor.

Hydrotreating processes utilizing a slurry of dispersed catalysts in admixture with a hydrocarbon oil are generally known. For example, U.S. Pat. No. 4,557,821 to Lopez et al discloses hydrotreating a heavy oil employing a circulating slurry catalyst. Other patents disclosing slurry hydrotreating include U.S. Pat. Nos. 3,297,563; 2,912,375; and 2,700,015.

Conventional hydrotreating processes utilizing a slurry system avoid some of the limits of a fixed bed system. In a slurry system, it is possible to use small particle catalysts without a high pressure drop. Further, it is possible to replace deactivated catalyst "on-stream" with fresh reactivated catalyst. However, the conventional slurry hydrotreating process at high reactor temperatures still is limited with respect to the overall degree of aromatics hydrogenation. At low temperatures, it is possible to obtain better heat transfer and mixing and to control any temperature rise so as to maintain a favorable equilibrium level. However, the overall reaction rates in the conventional slurry process at low temperatures are relatively poor. Poor reaction rates are believed to result from poisoning of the catalyst by organic nitrogen molecules in the feed being treated. Such compounds adsorb on the catalyst and tie up the sites needed for hydrotreating reactions.

The present process overcomes the limits and disadvantages of conventional hydrotreating by employing certain finely divided hydrotreating catalysts in slurry form to contact the feed. According to the present invention, sufficient catalyst sites are packed into the slurry such that most of the nitrogen molecules can be titrated, that is absorbed, on the slurry catalyst without adversely affecting the hydrotreating process. Excess catalyst sites are present such that sites free of nitrogen are capable of hydrogenating the aromatics in a low or essentially nitrogen free feed.

The hydrotreating process of the present invention has the advantage that it can occur even at low temperatures, for example 650° F to 700° F, where equilibrium is favorable. In a further aspect of the present invention, any nitrogen is subsequently removed from the catalyst in a high temperature reactivation step before the catalyst recontacts fresh feed.

BRIEF DESCRIPTION OF THE INVENTION

The present invention teaches a method of maximizing hydrogenation reaction rates of light fossil fuel feedstocks in a hydrotreating process while avoiding reaction equilibrium limits. These and other objects are accomplished according to our invention, which comprises passing the feedstock in admixture with a hydrogen containing gas through a hydrotreating zone in contact with a hydrotreating catalyst in slurry form such that substantial nitrogen removal, hydrodesulfurization, and aromatics hydrogenation is carried out. The catalyst particles are micron to ⅛ inch in average diameter and are characterized by an index, referred to as the excess catalyst index (ECI), equal to a value in the range of about 5 to 125, preferably about 30 to 90, according to the following formula:

$$ECI = \frac{W_s M_c}{W_f N_c}$$

wherein $W_f$ is the weight of the feed in lbs/hr, $N_c$ is the concentration of the nitrogen in ppm, $W_s$ is the rate of catalyst addition in lbs/hr and $M_c$ is the concentration of the metals on the catalyst in weight percent.

BRIEF DESCRIPTION OF THE DRAWINGS

The process of the invention will be more clearly understood upon reference to the detailed discussion below upon reference to the drawings wherein.

DETAILED DESCRIPTION OF THE INVENTION

Figure 1:
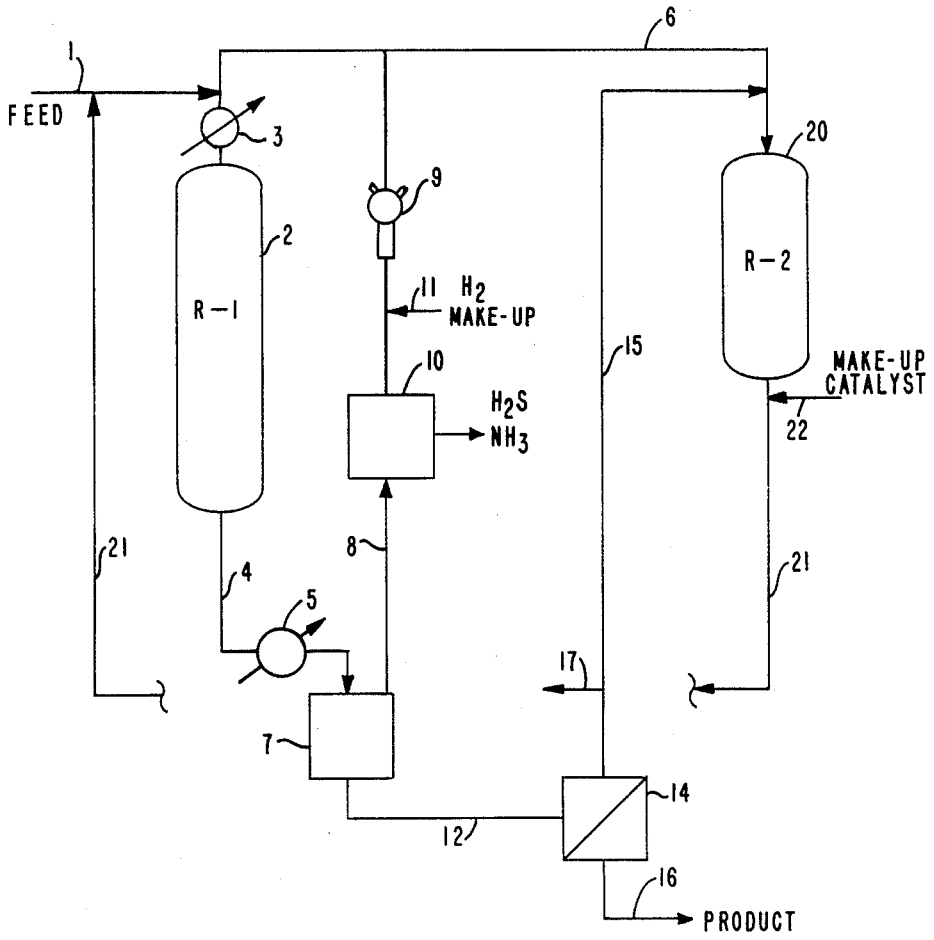
FIG. 1 shows a schematic diagram of one embodiment of a process according to this invention wherein an LCCO feed stream is hydrotreated.

Applicants' process is directed to a hydrotreating process using a hydrotreating catalyst of small particle size having a quantity of sites in excess of those required for reaction and/or adsorption of most if not all of the nitrogen compounds present when the catalyst is contacted with petroleum or synfuel feedstocks. In effect, the feedstock assumes a low nitrogen or essentially zero nitrogen character such that it can be contacted by the excess catalyst sites, allowing rapid hydrogenation of aromatics at low temperatures where equilibrium is favored. In a further aspect of the invention, it has been found that the catalyst, which contains adsorbed nitrogen from the hydrotreating step can be advantageously reactivated by high temperature denitrogenation before it is recontacted with high nitrogen fresh feed.

The slurry hydrotreating process of this invention can be used to treat various feeds including mid-distillates from fossil fuels such as light catalytic cycle cracking oils (LCCO). Distillates derived from petroleum, coal, bitumen, tar sands, or shale oil are likewise suitable feeds. On the other hand, the present process is not useful for treating heavy catalytic cracking cycle oils (HCCO), coker gas oils, vacuum gas oils (VGO) and heavier resids, which contain several percent 3+ ring aromatics, particularly large asphaltenic molecules. When treating heavier resids, excess catalyst sites are not obtainable, and reactivation of the catalyst by high temperature denitrogenation is not feasible.

Suitable feeds for processing according to the present invention include those distillate fractions which are distilled in the range of 350 to 750° F., preferably in the 400 to 700° F. range, and most preferably in the 430 to 650° F. range. Above 750° F., the feed is generally too heavy. Below 300° F., the feed is generally too light since substantial vapor is present. In general, the nitrogen content of the feed is suitably in the range of 350 to 1000 ppm, preferably 350 to 750 ppm. The concentration of polar aromatics, as measured by HPLC, is suitably less than 2 percent and the concarbon is suitably less than one-half percent. In terms of total aromatics, the percent is suitably higher, up to 50 weight percent or even greater.

Suitable catalysts for use in the present process are well known in the art and include, but are not limited to, molybdenum (Mo) sulfides, mixtures of transition metal sulfides such as Ni, Mo, Co, Fe, W, Mn, and the like. Typical catalysts include NiMo, CoMo, or CoNiMo combinations. In general sulfides of Group VII metals are suitable. (The Periodic Table of Elements referred to herein is given in *Handbook of Chemistry and Physics*, published by the Chemical Rubber Publishing Company, Cleveland, OH, 45the Edition, 1964.) These catalyst materials can be unsupported or supported on inorganic oxides such as alumina, silica, titania, silica alumina, silica magnesia and mixtures thereof. Zeolites such as USY or acid micro supports such as aluminated CAB-0-SIL can be suitably composited with these supports. Catalysts formed in-situ from soluble precursors such as Ni and Mo naphthenate or salts of phosphomolybdic acids are suitable.

In general the catalyst material may range in diameter from 1 μ to ⅛ inch. Preferably, the catalyst particles are 1 to 400 μ in diameter so that intra particle diffusion limitations are minimized or eliminated during hydrotreating.

In supported catalysts, transition metals such as Mo are suitably present at a weight percent of 5 to 30%, preferably 10 to 20%. Promoter metals such as Ni and/or Co are typically present in the amount of 1 to 5%. The surface area is suitably about 80 to 400 $m^2/g$, preferably 150 to 300 $m^2/g$.

Methods of preparing the catalyst are well known. Typically, the alumina support is formed by precipitating alumina in hydrous form from a mixture of acidic reagents in an alkaline aqueous aluminate solution. A slurry is formed upon precipitation of the hydrous alumina. This slurry is concentrated and generally spray dried to provide a catalyst support or carrier. The carrier is then impregnated with catalytic metals and subsequently calcined. For example, suitable reagents and conditions for preparing the support are disclosed in U.S. Pat. Nos. 3,770,617 and 3,531,398, herein incorporated by reference. To prepare catalysts up to 200 microns in average diameter, spray drying is generally the preferred method of obtaining the final form of the catalyst particle. To prepare larger size catalysts, for example about 1/32 to ⅛ inch in average diameter, extruding is commonly used to form the catalyst. To produce catalyst particles in the range of 200 μ to 1/32 inch, the oil drop method is preferred. The well known oil drop method comprises forming an alumina hydrosol by any of the teachings taught in the prior art, for example by reacting aluminum with hydrochloric acid, combining the hydrosol with a suitable gelling agent and dropping the resultant mixture into an oil bath until hydrogel spheres are formed. The spheres are then continuously withdrawn from the oil bath, washed, dried, and calcined. This treatment converts the alumina hydrogel to corresponding crystalline gamma alumina particles. They are then impregnated with catalytic metals as with spray dried particles. See for example, U.S. Pat. Nos. 3,745,112 and 2,620,314.

The catalyst used in the present process must have the necessary number of reaction sites. It has been found that the number of catalyst sites is related, as a practical matter, to a parameter defined as the "excess catalyst index" or ECI. The value of this index must equal a number in the range of about 5 to 125, preferably about 30 to 90. The ECI parameter, which determines the operating limits for a given catalyst and feed systems is defined as follows:

$$ECI = \frac{W_s M_c}{W_f N_c} \quad (1)$$

wherein $W_f$ is the weight of the feed in 1lbs/hr, $N_c$ is the concentration of the nitrogen in ppm, $W_s$ is the rate of catalyst addition in lbs/hr and $M_c$ is the concentration of the metals on the catalyst in weight percent.

The catalyst is used in the hydrotreating step in the form of a slurry. The catalyst concentration is suitably about 10 to 40 percent by weight, preferably about 15 to 30 percent.

In the hydrotreating process, the hydrodesulfurization, hydrodenitrogenation and aromatic hydrogenation reactions are a function of the total number of active sites on the catalyst. On a supported catalyst, the number of sites is proportional to the active metals content and the dispersion of those metals on the support. The sulfur, nitrogen and aromatic molecules present in the feed must absorb on these sites for reaction to occur. The nitrogen molecules absorb on these sites more strongly than other molecules in an LCCO or comparable feed and consequently such molecules are most difficult to react off. By providing excess catalyst sites, the nitrogen molecules in the feed can be titrated or removed from the feed, leaving excess sites available for hydrodesulfurization and aromatics hydrogenation. The aromatics hydrogenation reaction is especially fast on these free catalyst sites. The term ($W_sM_c$) in the ECI index is a measure of the total sites available. The term ($W_fN_c$) is a measure of the molecules of organic nitrogen in the feed. The ratio of these two terms provides an index which effectively measures the number of excess sites available for the desired reactions. According to the present process, the nitrogen remaining absorbed on the catalyst can be removed by separating the catalyst from the product and then exposing the catalyst to sufficiently severe conditions, particularly higher temperatures, such that the nitrogen is removed by hydrodenitrogenation.

Referring now to FIG. 1, a feed stream 1, by way of example a light catalytic cracker cycle oil (LCCO), is introduced into a slurry hydrotreating reactor 2 designated R-1. Before being passed to the hydrotreating reactor, the feed is mixed with a hydrogen containing gas stream 6 and heated to a reaction temperature in a furnace or preheater 3. Alternatively, the hydrogen gas in stream 6 can be introduced directly into the hydrotreating reactor 2. The reactor contains a slurried catalyst having, by way of example, a particle diameter of 10 to 200 $\mu$. Recycle of the reactor effluent via a pump is optional to provide mixing within the reactor. Alternatively, the feed may enter through the bottom of the reactor and bubble up through an ebulating or fluidized bed.

The process conditions in the hydrotreating reactor 2 depend on the particular feed being treated. In general, the hydrotreater is suitably at a temperature of about 550 to 700° F., preferably about 600 to 650° F. and at a pressure of about 300 to 1200 psig, preferably about 500 to 800 psig. The hydrogen treat gas rate is suitably about 200 to 2000 SCF/B (standard cubic feet per barrel), preferably about 500 to 1500 SCF/B. The space velocity or holding time ($W_R/W_f$ where $W_R$ is the catalyst held up in the hydrotreating reactor in lbs and $W_f$ is the rate of feed thereto in lbs/hr) is suitably about 0.5 to 4 hours and preferably about 1 to 2 hours.

The effluent from the hydrotreating reactor 2 is passed via stream 4 through a cooler 5 and introduced into a gas-liquid separator or disengaging means 7 where tho hydrogen gas along with ammonia and hydrogen sulfide by-products from the hydrotreating reactions may be separated from the liquid effluent and recycled via stream 8 and compressor 9 back for reuse in the hydrogen stream 6. The recycled gas is usually passed through a scrubber 10 to remove hydrogen sulfide and ammonia. This is usually recommended because of the inhibiting effect of such gases on the kinetics of hydrotreating and also to reduce corrosion in the recycle circuit. Fresh make-up hydrogen is suitably introduced via stream 11 into the recycle circuit. The liquid effluent from the gas-liquid separator 7 enters via stream 12 a solids separator 14, which may be a filter, vacuum flash, centrifuge or the like, in order to divide the hydrotreating reactor effluent into a catalyst stream 15 and a product stream 16. The product in stream 16 is suitable for blending in the diesel pool and contains less than 5 ppm nitrogen and less than 20 wt. % aromatics. The product is typically reduced in sulfur as well. In many cases, the product is given a light caustic wash to assure complete removal of $H_2S$. Small quantities of $H_2S$, if left in the product, will tend to oxidize to free sulfur upon exposure to the air, and may cause the product to exceed pollution or corrosion specifications.

In a further aspect of the present invention, the catalyst is reactivated by means of high temperature denitrogenation. Referring again to FIG. 1, the catalyst stream 15 from the solids separator 14, comprises typically about 50 weight percent catalyst. A suitable range is about 30 to 60 percent. The catalyst material is transported via stream 15 and after preheating introduced into reactivator 20, designated R-2, to react off most of the nitrogen molecules which occupy catalyst sites. Recycle hydrogen 6 is co-fed into the reactivator 20. The reactivator 20 yields a reactivated catalyst stream 21 for recycle back to the hydrotreating reactor 2. Fresh make-up catalyst is suitably introduced via stream 22 into the catalyst recycle stream 21 and spent catalyst may be removed via stream 17 from catalyst stream 15.

The reactivator 20 is suitably maintained at a temperature of about 700 to 800° F., preferably about 725 to 775° F., and at a pressure of about 500 to 1500 psig, preferably about 700 to 1000 psig. The hydrogen treat gas rate is suitably about 200 to 1500 SCF/B, preferably about 500 to 1000 SCF/B. The holding time is suitably about 0.5 to 2 hours, preferably about 1 to 1.5 hours ($W_{R'}/W_f$ where $W_R$, is the catalyst hold up in the reactivator in lbs and $W_f$ is the rate of feed thereto in lbs/hr).

EXAMPLE 1

A continuous slurry process was simulated using a batch autoclave. The autoclave was a 300 cc reactor equipped with an air driven stirrer operated at 450 RPM and sufficient internal baffling to ensure good mixing. The unit was also equipped with (1) a system to pressure the catalyst into the autoclave, (2) lines for continuous addition and removal of gas and (3) an internal line having a fritted disc to remove liquid for analysis. A commercially available hydrotreating catalyst was used having the following properties:

| | |
|---|---|
| NiO, wt % | 3.8 |
| $MoO_3$, wt % | 19.4 |
| Surface Area, $m^2$/gm | 175 |
| Pore Volume, cc/gm | 0.38 |

The catalyst was first crushed to 65–100 mesh and sulfided in a continuous flow of 1.5 liters/hr of 10% hydrogen sulfide in hydrogen at 350° C. The catalyst (5 gm) was slurried in a small quantity of the LCCO feed having the following properties:

| | |
|---|---|
| Sulfur, wt % | 1.27 |
| Nitrogen, ppm | 772 |
| Saturates, wt % | 19.7 |
| 1-ring Aromatics, wt % | 22.2 |
| 2-ring Aromatics, wt % | 42.0 |
| 3-ring Aromatics, wt % | 16.1 |

The slurry was placed in the catalyst addition hopper. Sufficient LCCO feed was added to the autoclave reactor to make a slurry containing 6 wt. % catalyst when the two were combined. The reactor was flushed with nitrogen and then hydrogen. The pressure on the reactor was increased to 750 psig with a continuous flow of hydrogen at 1.5–2.0 liters/hr which was used to purge from the reactor hydrogen sulfide generated during the hydrotreating step. The leaving gas was cooled to condense any liquid and returned to the reactor. The temperature of the autoclave was increased to 343° C. and the stirrer turned on at 450 RPM. Once the reactor had lined out at these conditions the catalyst in the catalyst addition hopper was pressured into the autoclave. Samples were withdrawn from the reactor at intervals and analyzed to determine the sulfur, nitrogen and aromatics/saturates content.

Figure 2:
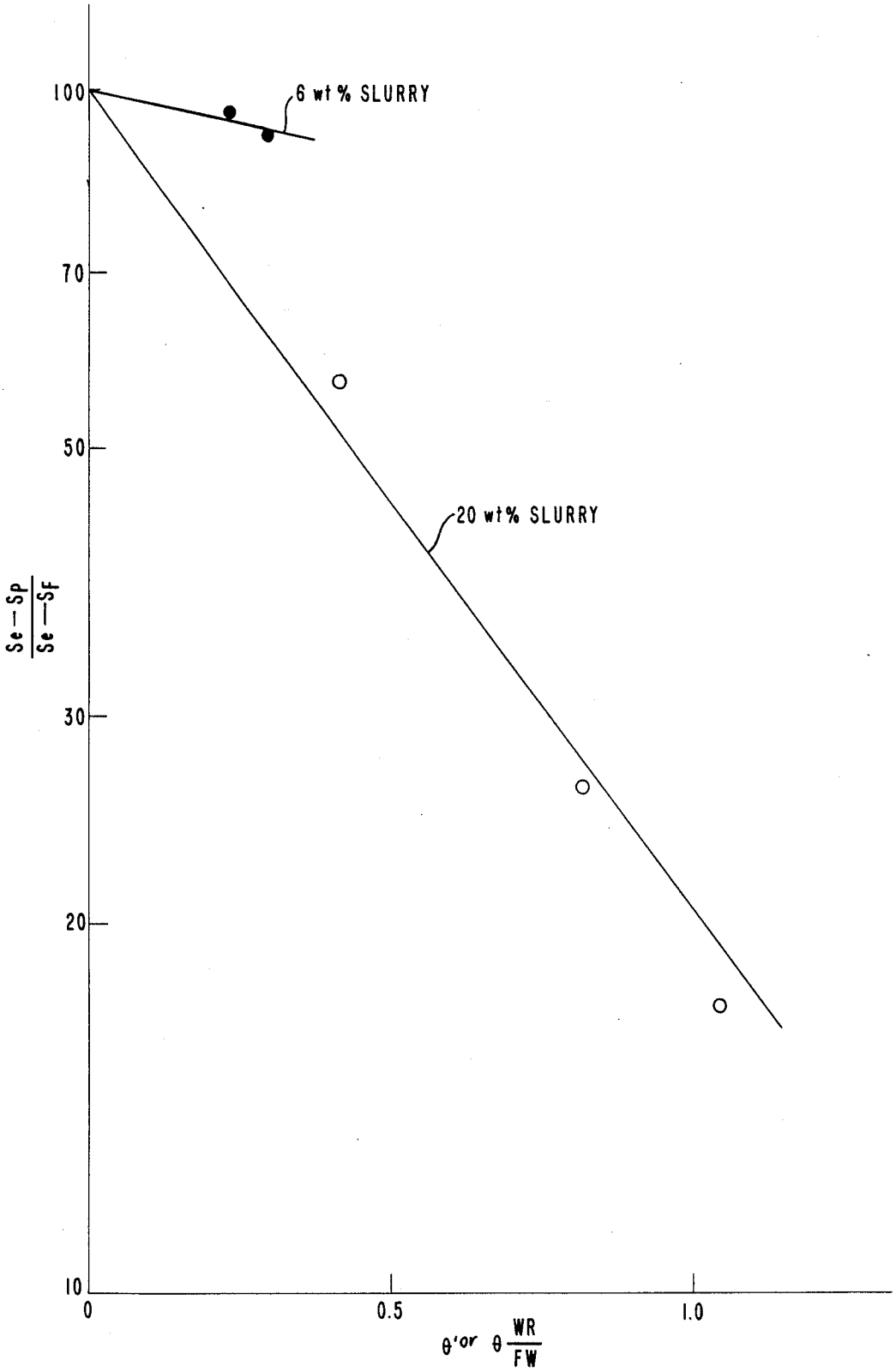
FIG. 2 contains a graph illustrating aromatics hydrogenation in a slurry hydrotreating process according to the present invention.
Figure 4:
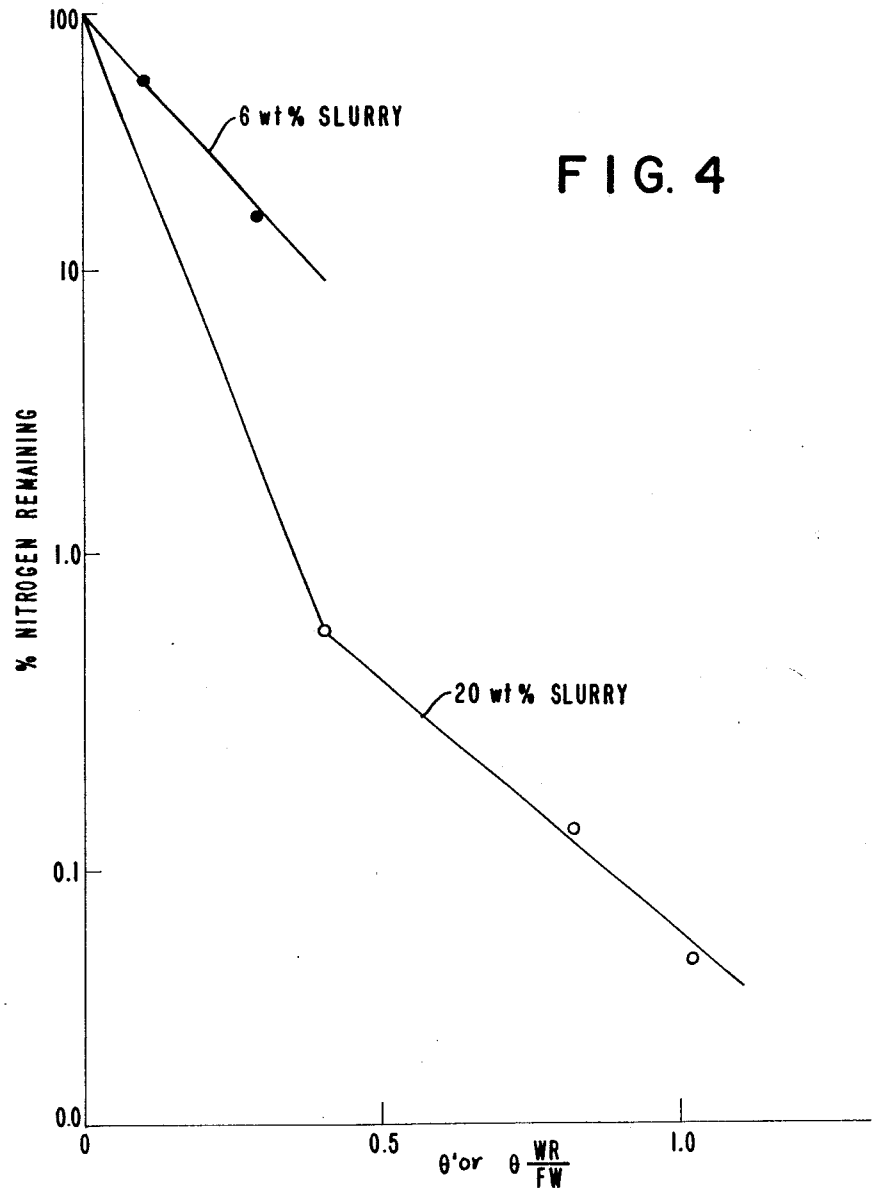
FIG. 4 contains a graph illustrating nitrogen removal in a slurry hydrotreating process according to the present invention.
Figure 3:
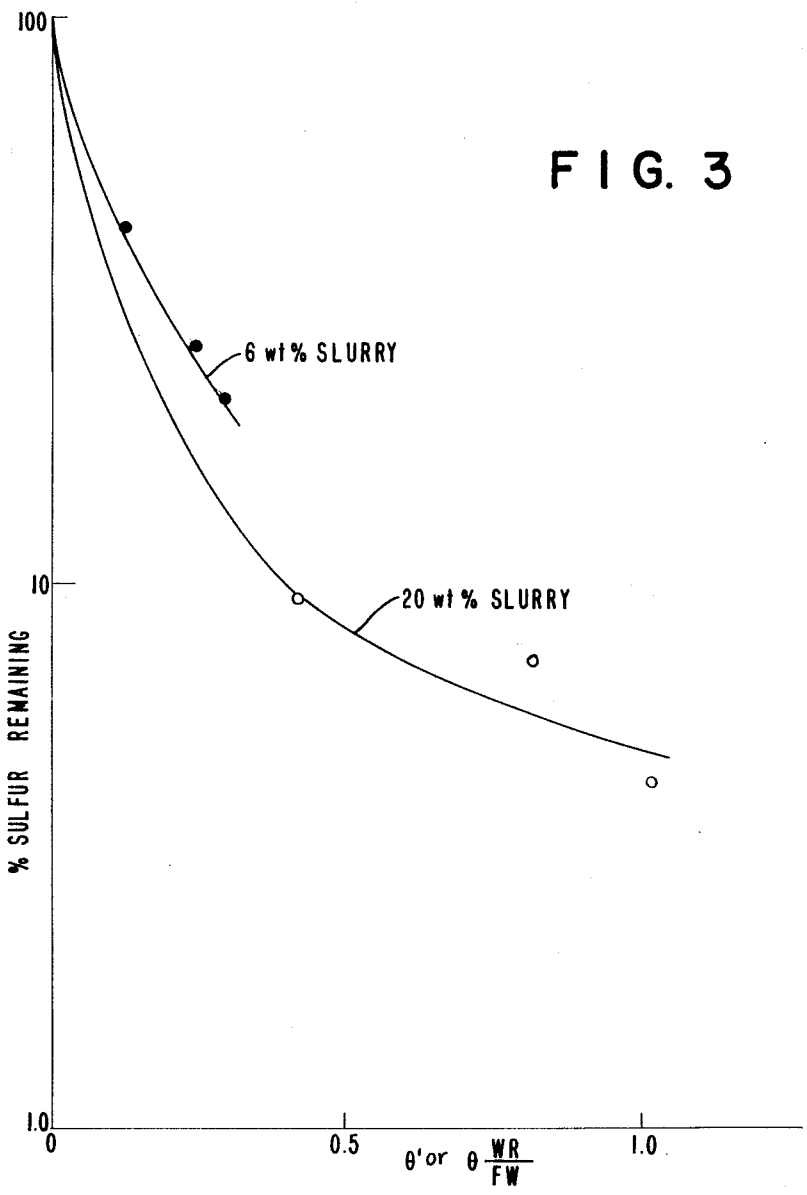
FIG. 3 contains a graph illustrating sulfur removal in a slurry hydrotreating process according to the present invention.

The sulfur and nitrogen content of the products was plotted in terms of % sulfur (FIG. 3) and % nitrogen (FIG. 4) remaining as a function of the corrected holding time which takes into consideration the amount of catalyst holdup in the reactor. In FIGS. 3 and 4, the symbols have the following definitions: $\theta'$ ,is the corrected batch autoclave holding time (hrs); $\theta$ is the actual batch autoclave holding time (hrs); $W_R$ is the amount of catalyst in the reactor (lbs); and FW is the amount of feed in the reactor (lbs). The percent nitrogen remaining is equal to 100 times the wt. % nitrogen in the product divided by the wt. % nitrogen in the feed. The percent sulfur removal is defined analogously. The saturates content of the products was plotted in FIG. 2. In FIG. 2, the symbols $\theta'$, $\theta$, $W_R$ and FW are as defined above and in addition, Se is the thermodynamic equilibrium saturates concentration (wt. %), SP is the product saturates concentration (wt. %) and $S_F$ is the feed saturates concentration (wt. %). In this case the formation of saturates is the slowest hydrogenation rate for hydrotreating catalysts which utilize molybdenum sulfides as catalysts and best reflect any improvements found with new catalysts or processes. Since this reaction is limited by thermodynamic considerations, it was necessary to determine by correlation the best equilibrium saturates composition ($S_e$) that would yield a straight line as shown on FIG. 2. In each of these cases the slope of the line is a measure of the reaction rate observed, and the rate constants derived from this analysis are shown in the following tabulation:

| | |
|---|---|
| Desulfurization (HDS) | 3.5 |
| Denitrogenation (HDN) | 5.4 |
| Saturates Hydro | 0.35 |

First order kinetics were used to calculate the rate constants for HDN and Saturates Hydro, but HDS employed 1.5 order kinetics.

EXAMPLE 2

The same procedure was followed in this example as was used in Example 1 with the exception that sufficient sulfided catalyst (10 gm) was placed in the catalyst addition hopper to provide a 20 wt. % slurry when the catalyst was added to the feed in the reactor. Once again samples were withdrawn at intervals and analyzed for sulfur, nitrogen and aromatics/saturates content. The data are shown on FIGS. 2–4 for the 20 wt. % slurry case. The equilibrium saturates content ($S_e$) determined in Example 1 was utilized in this example. The rate constants for the three reactions were calculated as described in Example 1, and the results are summarized as follows:

| | |
|---|---|
| Desulfurization (HDS) | 4.6 |
| Denitrogenation (HDN) | 12.4 |
| Saturates Hydro | 1.6 |

It is evident that increasing the concentration of catalyst in the slurry from 6 to 20 wt. % increased the HDS rate 30%, the HDN rate by 2.3 fold and the saturates hydrogenation rate by 4.6 fold. In the case of the HDN rate it is theoretical as to whether the nitrogen was removed from the nitrogen containing molecules or simply adsorbed onto the excess catalyst.

EXAMPLE 3

It is expected that some but not all of the nitrogen containing molecules would be denitrogenated at the lower temperature (343° C.) used for slurry hydrotreating in Examples 1 and 2, but it would be necessary to first separate the catalyst from the reactor product, heat it to an elevated temperature to perform complete HDN of the adsorbed nitrogen containing molecules and then return the reactivated catalyst to the slurry reactor for further hydrotreating of the fresh feed.

Denitrogenation data were obtained on a very similar LCCO (1.35 wt. % sulfur, 718 ppm nitrogen) in a fixed bed, continuous flow experiment with the same commercial hydrotreating catalyst as was used in Examples 1 and 2. After sulfiding with 10% hydrogen sulfide in hydrogen at conditions similar to those used in Examples 1 and 2 the catalyst was used to hydrotreat the LCCO feed at 500 psig, 625° F., 2200 SCF/B hdyrogen treat gas rate and 0.5 LHSV. The first order HDN rate constant calculated from these data was 0.85. It is known that the activation energy of the HDN reaction is 30 kcal/mol which projects a rate constant of 4.0 for the HDN reaction at 705° F. These data show that complete removal of the nitrogen from the catalyst could be attained, even if all of the nitrogen removed in the low temperature slurry hydrotreater was only adsorbed, at 750 psig, 705° F., 500 SCF/B hydrogen treat gas rate and 1.3 hours holding time ($W_R/W_F$).

The process of the invention has been described generally and by way of example with reference to particular embodiments for purposes of clarity and illustration only. It will be apparent to those skilled in the art from the foregoing that various modifications of the process and materials disclosed herein can be made without departure from the spirit and scope of the invention.

What is claimed is:

1. A process for hydrotreating a mid-distillate of a hydrocarbonaceous material, comprising:

passing the mid-distillate in admixture with a hydrogen containing gas through a hydrotreating zone in contact with a hydrotreating catalyst slurry such that substantial nitrogen removal, hydrodesulfurization and aromatics hydrogenation is carried out and wherein the catalyst comprises catalyst particles 1 micron to ⅛ inch in average diameter and are characterized by a value of about 5 to 125 on an index defined as the excess catalyst index (ECI) according to the following formula:

$$ECI = \frac{W_s M_c}{W_f N_c}$$

wherein $W_f$ is the weight of the mid-distillate in lbs/hr, $N_c$ is the concentration of the nitrogen in distillate in ppm, $W_s$ is the rate of catalyst addition to the hydrotreating zone in lbs/hr and $M_c$ is the concentration of the metals on the catalyst in weight percent.

2. The process of claim 1, wherein the ECI index is equal to a value ranging from about 30 to 60.

3. The process of claim 1, wherein the mid-distillate is a product of a petroleum, synfuel, coal, shale oil, bitumen, or tar sand conversion process.

4. The process of claim 1, wherein the mid-distillate is a light catalytic cracking cycle oil.

5. The process of claim 1, wherein the mid-distillate boils in the range of 350 to 750° F.

6. The process of claim 1, wherein the catalyst is comprised of molybdenum sulfide.

7. The process of claim 1, wherein the catalyst further comprises nickel and/or cobalt.

8. The process of claim 1, wherein the catalyst is supported on an inorganic oxide material.

9. The process of claim wherein the inorganic oxide material is selected from the group consisting of alumina, silica, titania, silica alumina, silica magnesia, and mixtures thereof.

10. The process of claim 1, wherein the molybdenum is present in the amount of 5 to 30 percent by weight in the catalyst.

11. The process of claim 1, wherein the nickel and cobalt is present in the amount of 1 to 7 percent by weight in the catalyst.

12. The process of claim 1, wherein the catalyst is 10 $\mu$ to ⅛ inch in average diameter.

13. The process of claim 11, wherein the catalyst is 10 $\mu$ to 400 $\mu$ in average diameter.

14. The process of claim 1, wherein the surface area of the catalyst is 80 to 400 $m_{2/g}$.

15. A process for hydrotreating a mid-distillate of a hydrocarbonaceous material, comprising:

passing the mid-distillate in admixture with a hydrogen containing gas through a hydrotreating zone in contact with a slurried hydrotreating catalyst such that substantial nitrogen removal, hydrodesulfurization and aromatics hydrogenation is carried out wherein the catalyst comprises particles 1 micron to ⅛ inch in average diameter and are characterized by a value ranging from about 5 to 125 on an Excess Cathalyst Index (ECI) index defined according to the following formula:

$$ECI = \frac{W_s M_c}{W_f N_c}$$

wherein $W_f$ is the weight of the feed to the hydrotreating zone in lbs/hr, $N_c$ is the concentration of the nitrogen in the mid-distillate in ppm, $W_s$ is the rate of catalyst addition to the hydrotreating zone in lbs/hr and $M_c$ is the concentration of the metals on the catalyst in weight percent;

reactivating the catalyst by high temperature denitrogenation; and recycling the reactivated catalyst to the hydrotreating zone.

16. The process of claim 15, wherein the ECI index is equal to a value ranging from about 30 to 90.

* * * * *